United States Patent [19]

Hong

[11] Patent Number: 5,033,138

[45] Date of Patent: Jul. 23, 1991

[54] REST UP APPARATUS FOR HEAD REST

[76] Inventor: Wen-ping Hong, P.O. Box 10780, Taipei, Taiwan

[21] Appl. No.: 242,889

[22] Filed: Sep. 12, 1988

Related U.S. Application Data

[63] Continuation of Ser. No. 133,800, Dec. 16, 1987, abandoned.

[51] Int. Cl.[5] ..... A47C 20/00

[52] U.S. Cl. ..... 5/437; 5/440

[58] Field of Search ..... 5/98.13, 127, 129, 431, 5/434, 437, 490, 443, 435, 461, 468; 294/140, 149

[56] References Cited

U.S. PATENT DOCUMENTS

| | | | |
|---|---|---|---|
| 470,819 | 3/1892 | Davis | 5/440 |
| 926,563 | 6/1909 | Hobson | 5/440 |
| 1,098,236 | 5/1914 | Duckworth | 5/440 |
| 1,211,871 | 1/1917 | Peoples | 5/440 |
| 2,694,208 | 11/1954 | Christensen | 5/122 |
| 4,188,063 | 2/1980 | Dusart | 5/122 X |
| 4,651,366 | 3/1987 | Lande et al. | 5/94 X |

FOREIGN PATENT DOCUMENTS

| | | | |
|---|---|---|---|
| 385129 | 12/1932 | United Kingdom | 5/440 |
| 525996 | 3/1940 | United Kingdom | 5/440 |

*Primary Examiner*—Michael F. Trettel

*Attorney, Agent, or Firm*—Pollock, Vande Sande & Priddy

[57] ABSTRACT

The apparatus provides a device wherein the adjustable belt-like means is stretched over between two pole-like supports, and the head bearing area of the belt-like means can bear a head more evenly with a larger and generally spheric area.

7 Claims, 8 Drawing Sheets

FIG 5
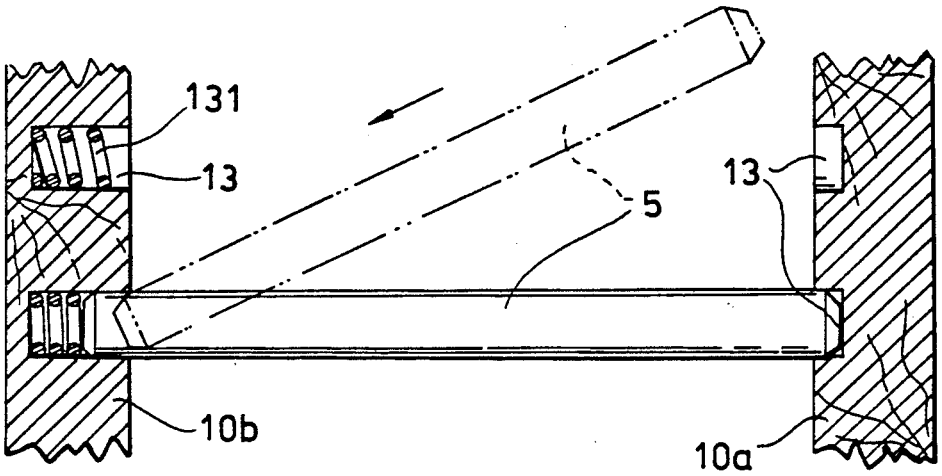
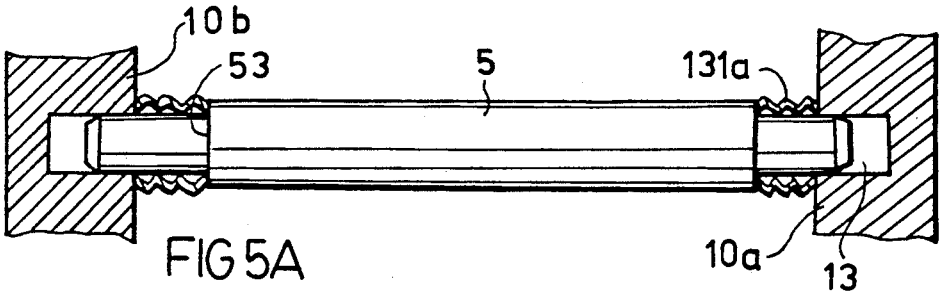
FIG 5A
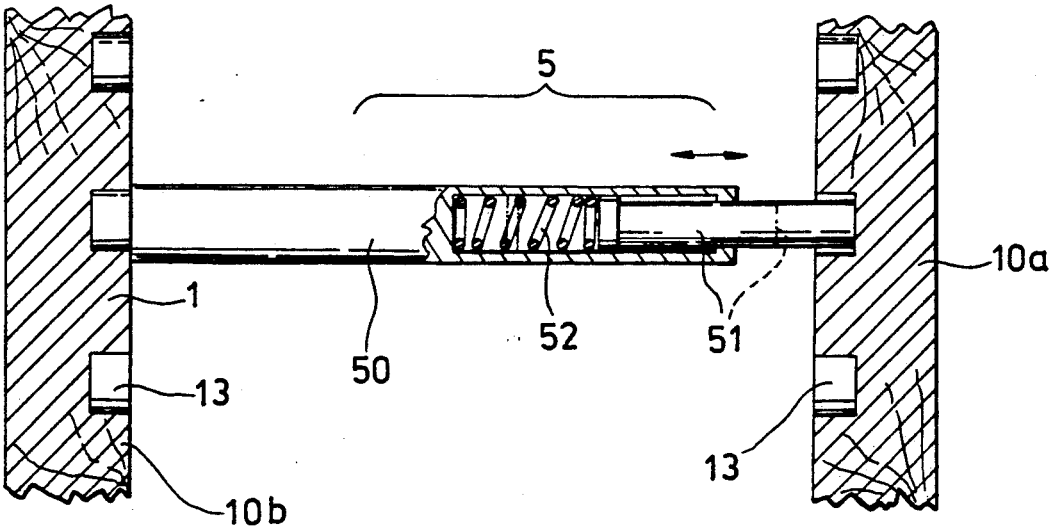
FIG 6

REST UP APPARATUS FOR HEAD REST

CROSS-REFERENCE TO RELATED APPLICATION

This application is a continuation of application Ser. No. 07/133,800, filed Dec. 16, 1987, now abandoned.

BACKGROUND OF THE INVENTION

This invention relates to an apparatus for bearing a head evenly. The purpose of the pillow is to make a sleeper's head be borne in a favourable height in order to ease shoulder and neck muscles, and to bear the head with more proper area to reduce heat or regional ache happening to the head during sleep, or else the epidermis of the head will often reflex heat and ache to the sleeper to turn over his body. Therefor it is evident that the sleeper, if his head is stimulated again and again, can't get sufficient rest.

Since an infant under six months old cannot turn over himself, he will, if without proper help from his mother, feel uncomfortable and might cry due to the heat generated by the contact of his head and the pillow, and his skin will easily be inflamed because of the heat and sweat. If the pillow is not soft enough, the infant's head could be transfigured. Although a transfigured head has a larger area to contact with the pillow and will therefore comfort the infant, the internal pressure of the head will increase and the abnormal un-spheric space inside of the head will also prevent the infant's brain cell from growing normally. Therefore the possibility of negative influence to the infant's wisdom cultivation exists. Once the infant is grown with a transfigured head and there is no appropriate pillow which can bear his head evenly, his head will naturally contact with the pillow by the transfigured flattened area of his head everytime he feels uncomfortable or hot while sleeping. Accordingly, the transfiguration of the head is increasingly hard to be corrected.

There is obviously a need to improve the defect of a hard pillow; providing a proper height of the pillow is also needed to help the sleeper to obtain good rest.

The conventional soft pillow, with its inner stuff which can obstruct the air from normally circulating, can neither dissipate the heat on the pillow properly, nor bear the head evenly, and it will even obstruct the infant's breathing if the sleeping posture of the infant is not proper. The design of a pillow or similar means, which can bear a head more evenly and help to make the infant's head to grow in a spheric shape and can be adjusted in height to fit everyone, is really of great necessity.

The British Patent No. 525,996 obtained by Fowler et al. provided a pillow with spaced apart uprights which are attached together by cross beams. A clothes support is stretched over the beams and is attached at both ends to the uprights between spaced beams. The above mentioned pillow can bear a head more evenly in only the cross direction; similarly, British Patent No. 385,129 of Bury, British Patent No. 25,953 of Yaung, British Patent No. 830,837 of Hurst, and British Patnet No. 186,481 of Galley disclosed the pillows that can bear a head evenly in only the cross direction of the pillow instead of in a whole spheric area.

The U.S. Pat. No. 3,403,413 of Calhoun et al provided a pillow-like apparatus by using a plurality of mattress-like segments which each includes a base and a pair of laterally-spaced sides depending upward from the base. However, the disclosed apparatus cannot adjust the height of the support. Please keep in mind that though the mattress-like segment seems to have formed a spheric area to bear a head, the fact is that it bears a head with only about 10 supporting points, which number is just a little more than an ordinary one, and that is not suitable for infants to use with.

According to British Patent Nos. 830,837 and 525,996 an adjustable support is disclosed. Though the support is adjustable with a predetermined distance, it cannot be adjusted in smaller space. Further details are discussed hereinbelow.

THE OBJECT OF THE INVENTION

The object of this invention is to provide an apparatus that can bear a head with a generally spheric pillow surface, regardless of the sizes of the users' heads.

The other object of this invention is to provide a new method and apparatus, whereby the pillow height is adjustable.

It is still another object of this invention to provide an apparatus of which the pillow embodiment can be folded.

This apparatus is not confined to be used only in a pillow, it can also be applied as a support in a baby carriage so that the infant can rest his head on it comfortably and get sufficient rest.

BRIEF DESCRIPTION OF THE DRAWINGS

FIG. 5 is a partial sectional view taken along line 5—5 of FIG. 3 illustrating the first embodiment of the connection of the base-plates and the standards.

FIG. 5*a* is the second embodiment of FIG. 5.

FIG. 6 illustrates the third embodiment as shown in FIG. 5.

DETAILED DESCRIPTION OF THE PREFERRED EMBODIMENT

Figure 1:
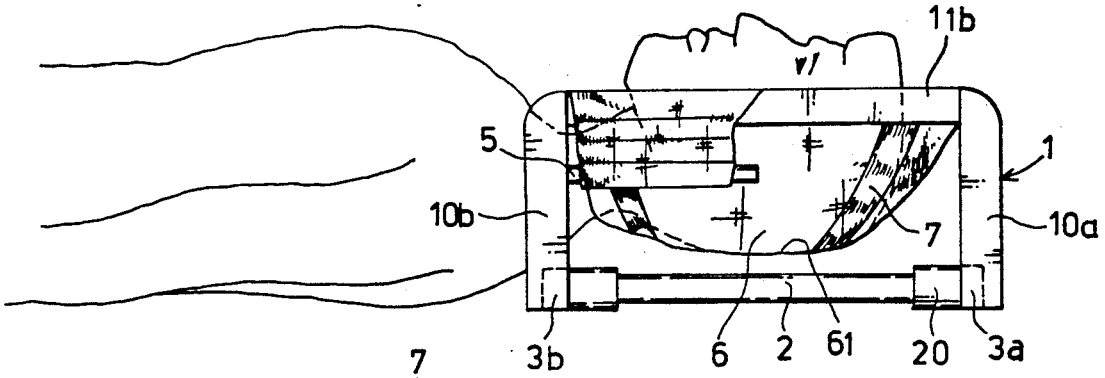
FIG. 1 is a side elevational view of the preferred embodiment of the invention.
Figure 1A:
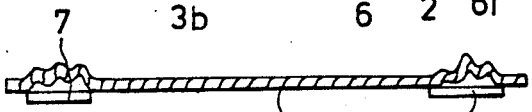
FIG. 1*a* is a partial elevational sectional view of the pillow surface of FIG. 1 illustrating the state before bearing a head.
Figure 1B:
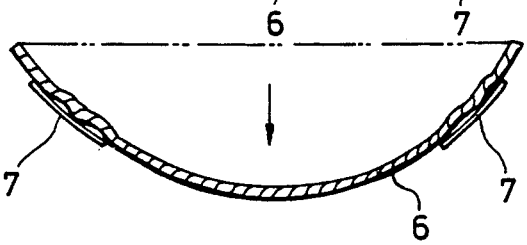
FIG. 1*b* is a partial elevational sectional view of the pillow surface of FIG. 1 illustrating the state while bearing a head.
Figure 2:
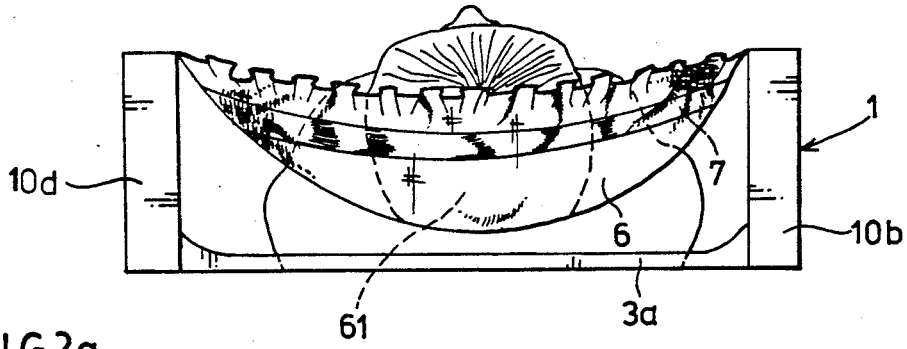
FIG. 2 is a front elevational view of the preferred embodiment of the invention.
Figure 2A:
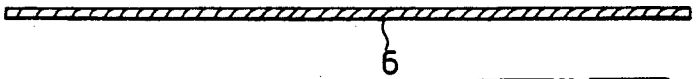
FIG. 2*a* is a partial elevational sectional view of the pillow surface of FIG. 2 illustrating the state before bearing a head.
Figure 2B:
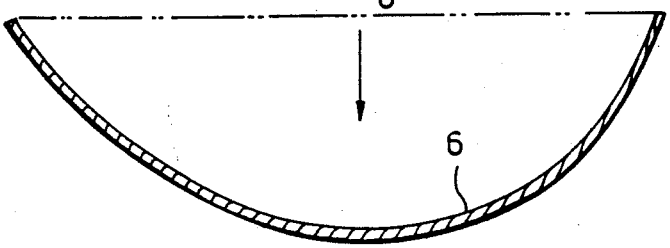
FIG. 2*b* is a partial elevational sectional view of the pillow surface of FIG. 2 illustrating the state while bearing a head.

Please refer to FIGS. 1, 1*a*, 1*b*, 2, 2*a*, 2*b*, and 4. The pillow surface of the present invention is made of a belt-like means 6 of flexible clothes or weave. Two elastic bands 7 are sewed respectively and tangently on either two opposite sides of the head bearing area 61 in the direction of latitude, longitude or any other angle, and the belt-like means is therefore kept as a not completely stretched wrinkled surface as shown in FIGS. 1*a* and 2*a*. When the user rests his head on the head bearing area 61, the belt-like means 6 will curve downward, and thereof the wrinkled surface will stretch out completely along the shape of the head as shown in FIGS. 1*b*, and 2*b*. The head bearing area 61 contacts the head with a larger area, on which the lowest point of the head serves as a center, and disperses thereby the weight of the head to all directions instead of on a certain few points. The wrinkled surface of the belt-like means 6, when being pressed, will stretch completely and form a generally spheric shape which helps forming the infant's unhardened head to grow in a shape more close to a spheric shape and also helps the infant's brain cell to grow normally.

Figures 3, 3A:
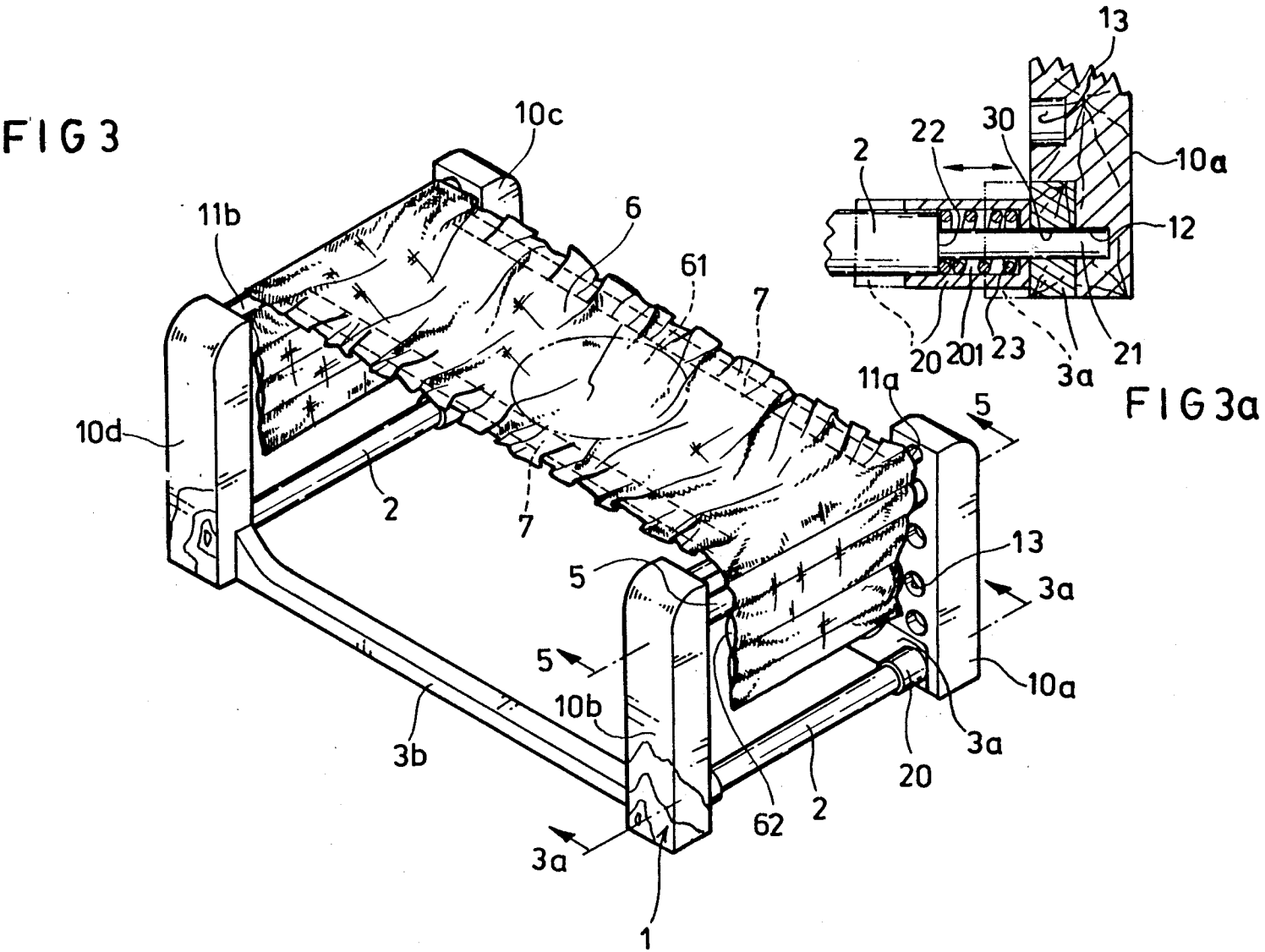
FIG. 3 is a perspective view of the preferred embodiment of the invention.
FIG. 3*a* is a partial sectional view taken along line 3*a*—3*a* of FIG. 3.
Figure 4:
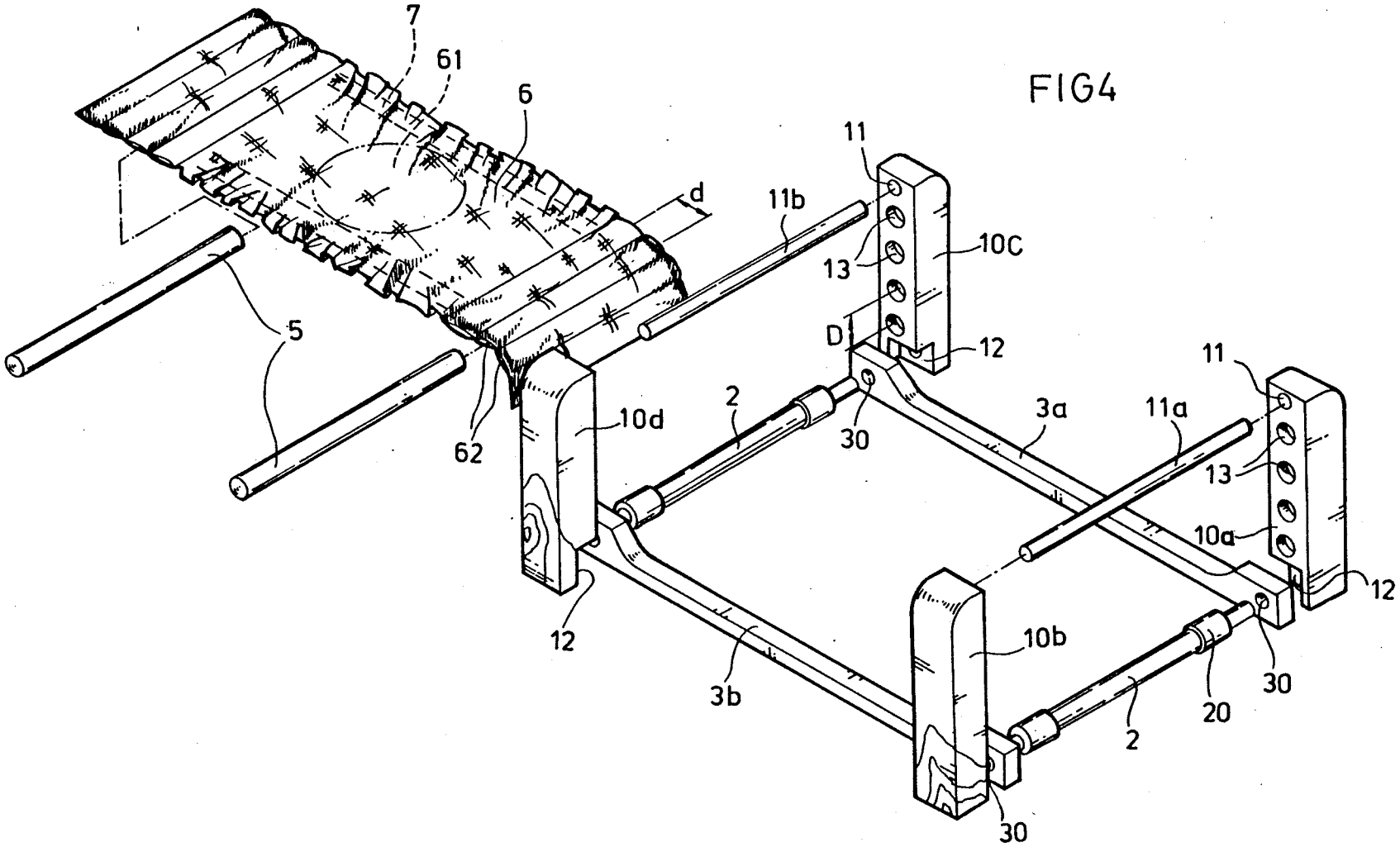
FIG. 4 is an exploded perspective view of the preferred embodiment of the invention.
Figure 7:
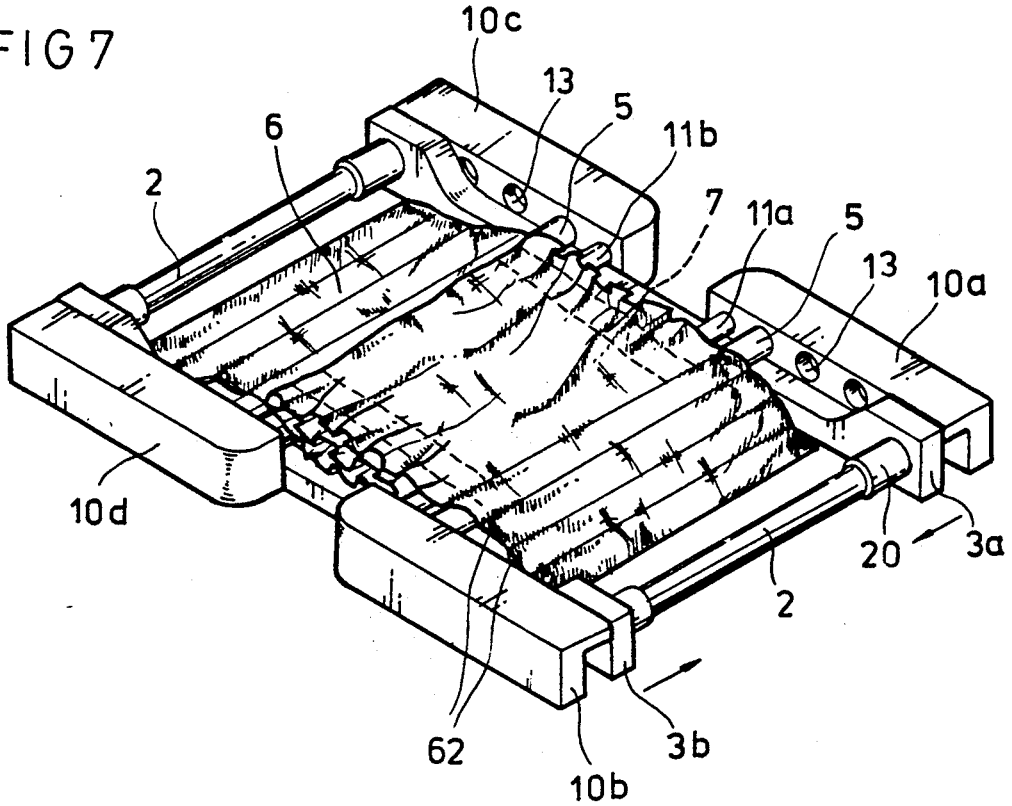
FIG. 7 is a perspective view of the preferred embodiment of the invention in a folded situation.

Both ends of the belt-like means 6 can be held on the pole-like support which will be discussed hereinbelow. The first embodiment is illustrated in FIGS. 3, 4, and 7, wherein both ends of the belt-like means 6 are held on a pair of up-beams of the support 1 which consisted of four generally vertical standards 10*a*, 10*b*, 10*c* and 10*d* standing respectively at four corners of a rectangular. (Please note that the standards may be of 3 or 5, but it will complicate the construction and make it harder to illustrate.) The two up-beams 11*a* and 11*b* are separately fixed on each pair of front and back standards i.e. 10*a*–10*b* and 10*c*–10*d*. On the two opposite of each pair of standards, are provided certain aligned up-beam holes 13 wherein each pair of the opposite holes are of the same height.

At the lower part of each standard, there is provided a notch 12 serving as a shoulder and there is a hole 121 made horizontally in each notch 12. Between the standards 10*a* and 10*c*, as well as 10*b* and 10*d*, a latitudinal base-plate 3*a*, as well as another base-plate 3*b*, of which hole 30 is provided at each end of the base-plates 3*a* and 3*b*, is attached onto each pair of the notches 12 at the lower parts of the standards. Between the standards 10*a* and 10*b*, as well as 10*c* and 10*d*, a longitudinal base-beam 2 is installed thereon. As illustrated in FIG. 3*a*, each base-beam 2 has a smaller diameter at its both ends 21 so as to form a shoulder 22. The diameter of the ends 21 is also smaller than that of the above mentioned holes 30 of the latitudinal base-plates 3*a* and 3*b*, but is about the same diameter of the holes 121 in the notches 12 of the standards 10*a*, 10*b*, 10*c*, and 10*d*. Accordingly, the base-beams 2 can be tightly encased into the holes 121 through the holes 30 and be fixed onto the standards. A cover 20 with one end partialy obstructed, wherein the diameter of the hole 201 of the cover 20 is larger than that of the longitudinal base-beams 2, can slide on the base-beams 2. Inside of the hole 201, an elastic means, e.g. a spring 23, is installed to lean one end against the obstructed end of the hole 201 of the cover 20 and the other end against the shoulder 22 of the base-beams 2. The cover 20 can thereby always press the longitudinal base-beams 3*a* to be kept inside of the notches 12 between the standards 10*a*–10*c*, similarly, the base-beams 3*b* is kept inside of the notches 12 between standards 10*b*–10*d*; thus, the standards 10*a*, 10*b*, 10*c*, and 10*d* are always kept upon the base-plates 3*a*/3*b* and the base-beams 2 in a vertical condition. But if the cover 20 moves left to the dotted line as shown in FIG. 3*a*, that is, moves toward the center part of the base-beams 2, the latitudinal base-beam 3*a* is forced to leave the notches 12 of standards 10*a*–10*c*; similarly, the base-beam 3*b* is forced to leave the notches 12 of the standards 10*b*–10*d*. Thus the standards 10*a*, 10*b*, 10*c*, and 10*d* will fall centerwards forming an easy carrying folded flat rectangular embodiment of the invention.

In order to adjust the height of the bearing area 61 at the central part of the belt-like means 6 to fit different users, some tube-like hems 62 are made on at least one end of the belt-like means. As shown in FIG. 4, each hem 62 is kept from each other by a distance marked as d, which is different from that marked as D of the holes 13 of the standards 10*a*, 10*b*, 10*c*, and 10*d*. By this special device, an adjustable distance, being shorter than d or D, is thereby made possible. The hems 62 at both ends of the belt-like means 6 are designed to receive the pole 5 which is longer than the hem 62, and both ends of the pole are to be encased into the holes 13 of the standards 10*a*, 10*b*, 10*c*, and 10*d*. Please note the marks d and D in FIG. 4. When a pole 5 is moved from the original hem to the adjacent hem, the moved distance is d, and let us suppose it is 3 cm; on the other hand, when a pole 5 is moved from the origional hole of the standard to the other adjacent hole, the moving distance is D, and let's suppose it is 2 cm. A difference between D and d comes out accordingly and it is smaller than both D and d; here the difference is 1 cm. Therefore, there are three adjustable distance D, d or D-d in the present invention for adjusting the bearing area 61 of the belt-like means 6 to a more preferable height.

There are three typical embodiments illustrated in FIGS. 5, 5*a* and 6 which show the apparatus for encasing the pole 5 between the standards and removing it from the holes 13 of the standards to adjust the height of the belt-like means 6 which is stretched over the upper beams of 11*a* and 11*b*.

The first embodiment is shown in FIG. 5, wherein the paired holes 13 of either pair of the standards 10*a*–10*b* or 10*c*–10*d*, here is the pair of 10*a*–10*b*, is pre-fixed with a flexible means in it, e.g. the rubber, or a compressed spring 131 which is applied in this example. One end of the pole 5 is firstly encased into one of the holes 13 of the standard 10*b*, then the other end of the pole is encased into the opposite horizontal hole of the standard 10*a*, and when the spring 131 is pressed, the pole 5 will always be kept inside of one pair of the holes 13 until the height adjustment is desired.

The next embodiment shown in FIG. 5*a* illustrates a pole 5 with two smaller ends which enable the pole 5 to be encased into one pair of the holes 13 of the standards 10*a* and 10*b*; there are flexible means 131*a* being affixed respectively between each shoulder 53 of the pole 5 and the related standard 10*a* or 10*b* so as to achieve the function as shown in FIG. 5.

Another embodiment is illustrated in FIG. 6, wherein the pole 5 consists of two mutually encased poles 50 and 51. Between the poles 50 and 51, a spring 52 is installed to keep the jointed poles 50/51 in a certain length. While one of the poles is forced to come near to the other, the spring is pressed and the total length of this jointed poles is therefore shortened to be shorter than the distance between the two standards 10*a* and 10*b*, so that the poles 50 and 51 are allowed to enter between the standards to select a proper pair of holes, and after the pressure of the spring is released, the poles will be encased into the holes of the standards 10*a* and 10*b*, and always be kept between the standards 10*a* and 10*b* by the spring 52.

As above mentioned, the belt-like means 6 is stretehed over the up-beams 11*a* and 11*b*, and the two separate poles 5 are selectively received into any hem 62 at both ends of the belt-like means and encased into any pair of the holes 13 of a pair standards to adjust the height of the bearing area 61 of the belt-like means 6. But it should also be noted that though the structure disclosed above provides a preferable easier adjusting device, it is not intended to limit the application of the present invention. Take for example, the belt-like means 6 can be stretched over the handrails on the two sides of the upper part of the baby carriage, that is to take the handrails as the up-beams, and the two ends of the belt-like means 6 are fixed by an appropriate device so that the head bearing area can be kept in a favourable height, thus the purpose of forming a larger head bearing area 61 is achieved; similarly, the belt-like means 6 can be stretched over other means and be fixed by proper ways to keep the head bearing area in a favourable height to achieve the same purpose.

Figure 8:
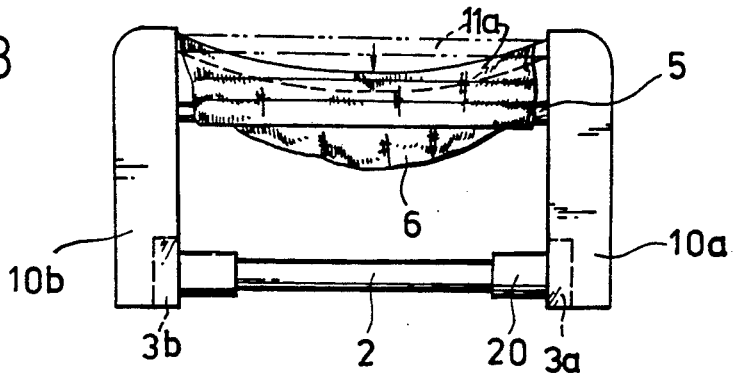
FIG. 8 is a side elevational view of the second embodiment of the invention.
Figure 9:
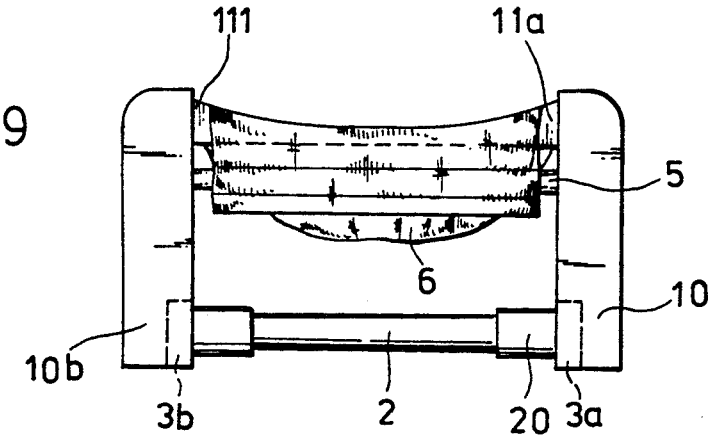
FIG. 9 is a side elevational view of the third embodiment of the invention.

Additionally, the same function of the above mentioned head bearing area 61 of the belt-like means 6, which can bear a head with a larger spheric area and to which even if the elastic band is not sewn, can also be achieved by changing the construction of the up-beams of the support. The first device, as shown in FIG. 8, is provided with two flexible up-beams 11*a* and 11*b* made of rather flexible and elastic material. When the user rests his head on the belt-like means, the up-beams will bend downwards in accordance with the dotted line to a curved shape by the strength dispersion. Alternatively, as shown in FIG. 9, the up-beams 11*a* and 11*b* can be made of less flexible material, but are provided with arc surface on the upward sides 111 which is preformed according to the strength dispersion so as to help to disperse the head weight more evenly.

Figure 10:
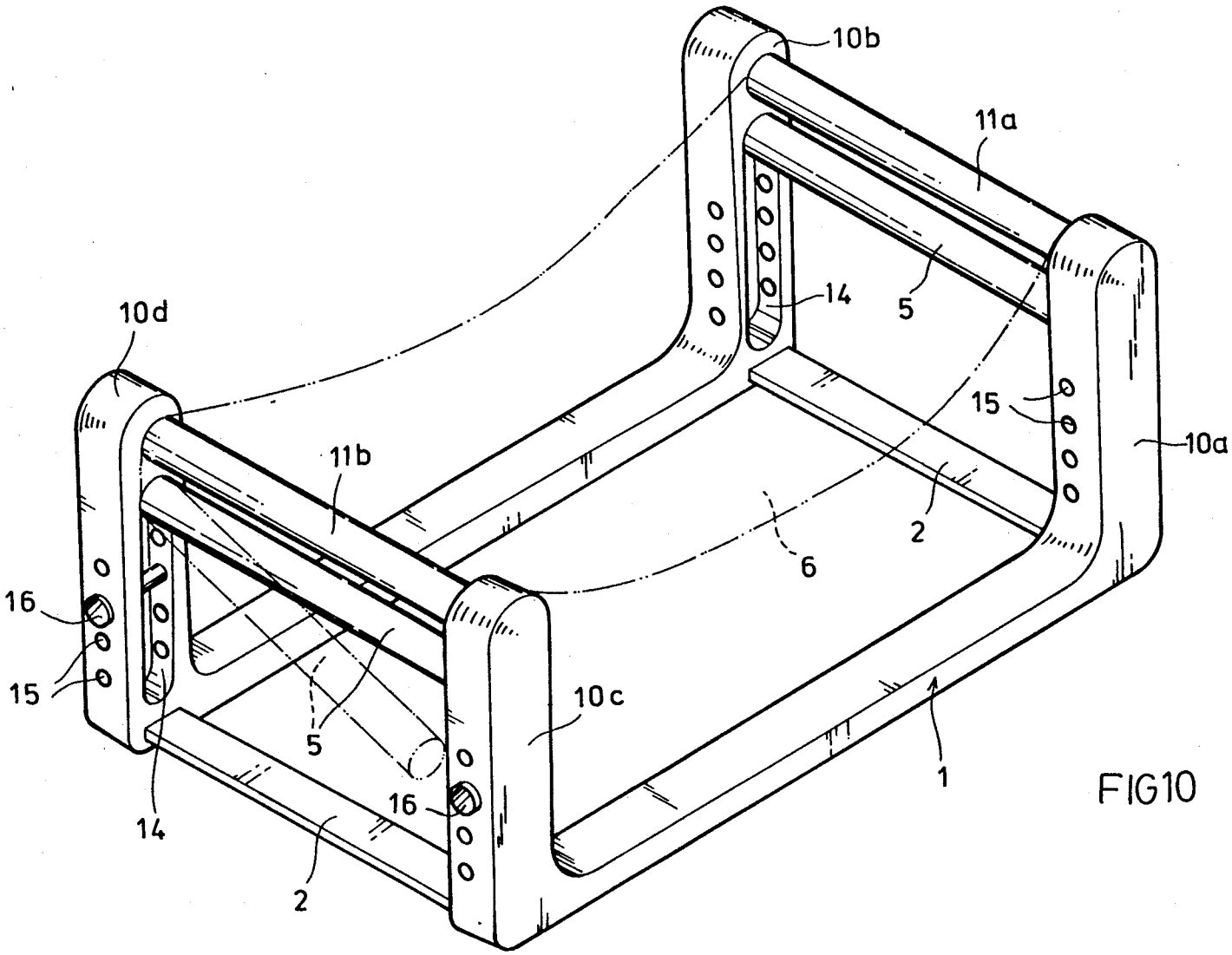
FIG. 10 is a perspective view of the second embodiment of the support of the invention.

FIG. 10 shows that both ends of the belt-like means 6 are stretched over the up-beams of the other embodiment of the support 1.

In this embodiment, two latitudinal base-beams are respectively connected to and integrated with the standards 10*a*–10*c* and 10*b*–10*d*. Attaching with the longitudinal up-beams 11*a* and 11*b* and the longitudinal base-beam 2 to connect the two integrated base-beams, a parallelepiped-like embodiment is thus formed. The longitudinal base-beams applied herewith does not have to be shortened. On the latitudinal inward sides of the four standards 10*a*, 10*b*, 10*c* and 10*d*, there is provided a slot 14 on each standard, and certain holes 15 are made latitudinally to pass through the slot 14 horizontally. The slot 14 is a little wider than the diameter of the pole 5, so that the pole 5 is able to move easily up and down in the slots 14 of a pair of opposite standards e.g. 10*a* and 10*b*. The horizontal holes 15 are used to receive the pins 16 which can be selectively fixed into any hole 15 to prevent the pole 5 from being moved upwards in the slots 14 by the pulling strength of the belt-like means 6. Accordingly, the height of the central head bearing area of the belt-like means 6 is relatively adjusted by changing the position of the pins 16.

Figure 11:
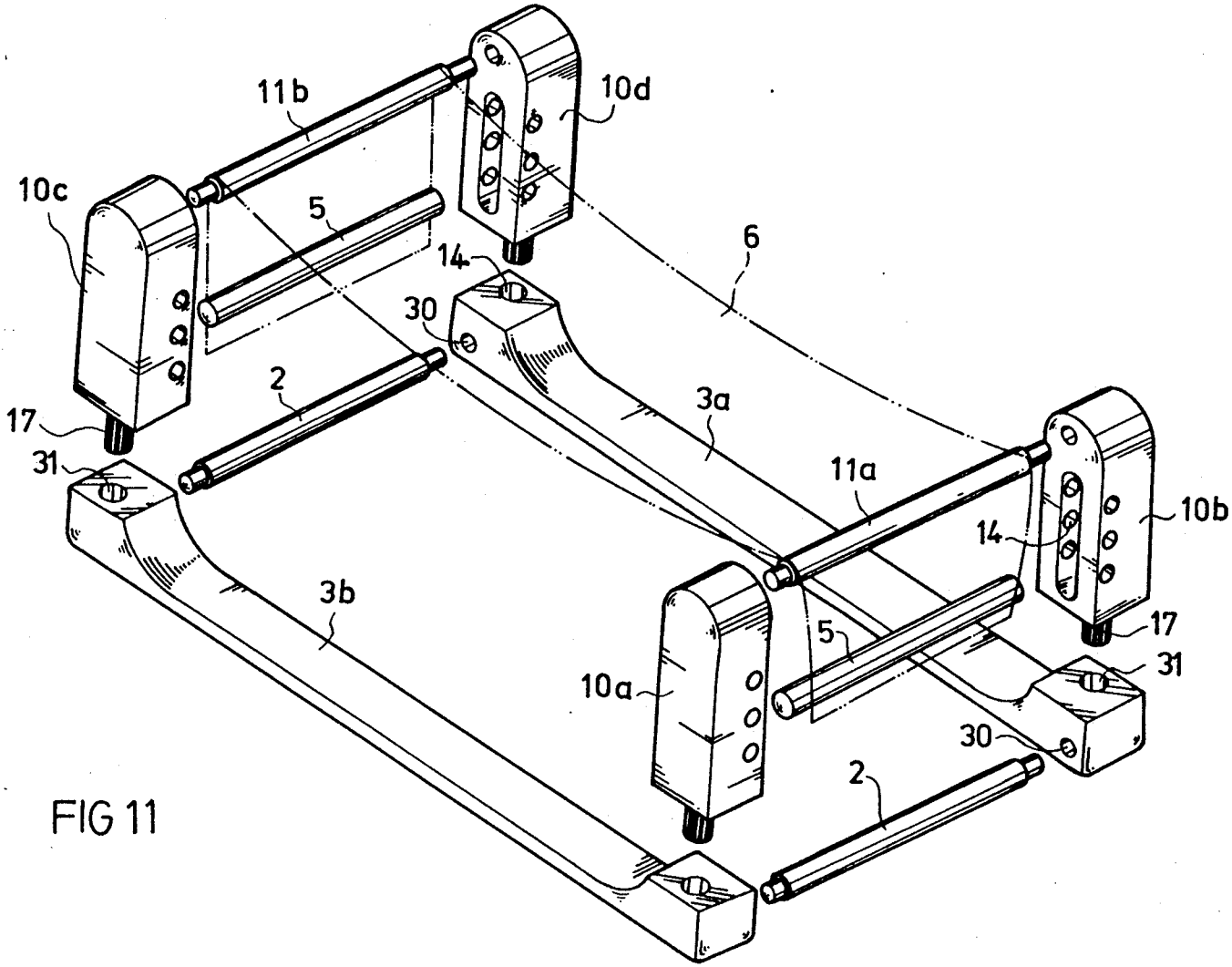
FIG. 11 is a exploded perspective view of the third embodiment of the support of the invention.

In order to achieve a better combinability of the support shown in FIG. 10 for a convenient storage and delivery, another embodiment of the support is illustrated in FIG. 11, wherein the standards 11*a*, 11*b*, 11*c* and 11*d* are separately attached to the latitudinal base-beams by the poles 17, installed respectively at the lower end of each standard, encasing respectively into the four holes provided on the four ends of the two base-beams 3*a* and 3*b*. Thus, the same function of the support in FIG. 10 is achieved, but with the only difference that, all the standards, base-beams, up-beams and poles of FIG. 11 can be dismantled and stored in a smaller storage space.

Figure 12:
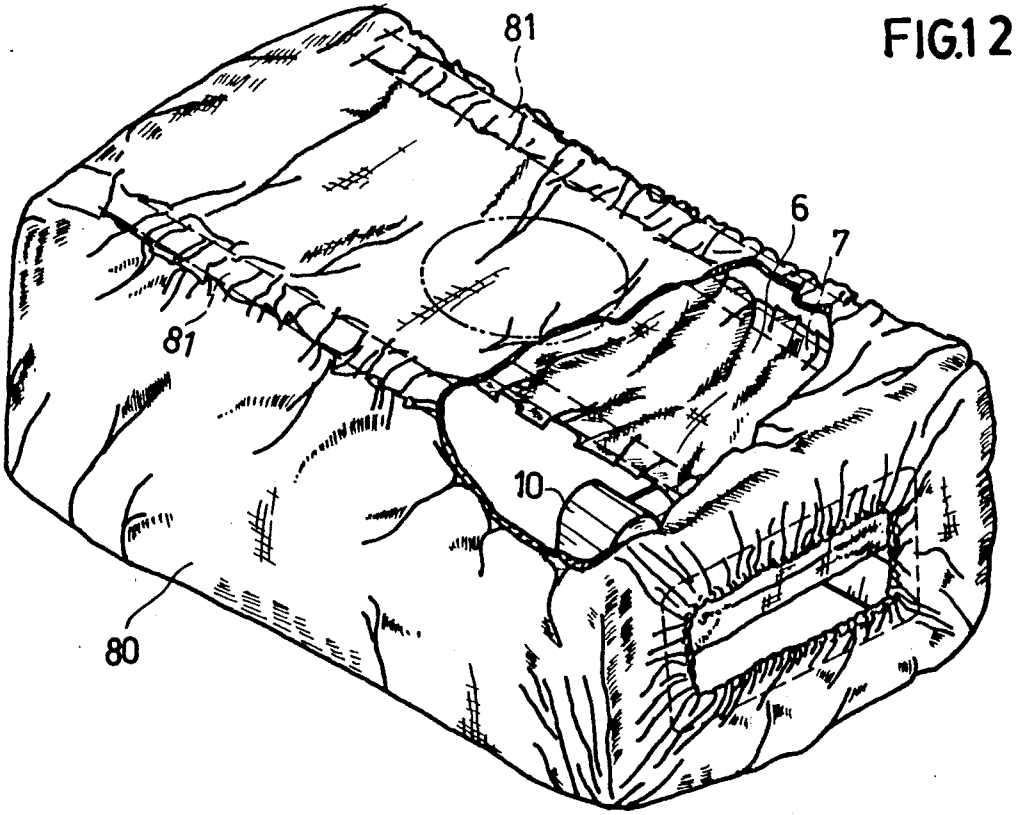
FIG. 12 is a perspective view of the other preferred embodiment of the invention.

It is obvious that the disclosure of the invention is to form a generally shperic head bearing area 61 which can contact the user's head with a larger area so that the head weight will be dispersed more evenly on the whole surface instead of on certain points. Thus, whether the head bearing area 61 is held by a specific means or an unspecific means as a support, the same purpose of making the sleeper to get sufficient rest will be achieved. Also, as shown in FIG. 12, a cover 80, to which at least two elastic bands 81 are sewed just as the aforementioned methods of the belt-like means 6 to which the elastic bands 7 are sewed, and which can help to increase the safety of the pillow, can also be applied in the present invention. In accordance with the disclosure of the invention, any prefered embodiments even if not revealed here by the illustration or statements is supposed to be included in the scope of the claims of the invention.

I claim:

1. An apparatus for use as a head rest comprising:

a belt-like means with a head bearing area which will form a generally spheric surface when bearing a head;

a support means formed with an empty interior space and having at least two pole-like means attached thereto, wherein over said pole-like means the said belt-like means is stretched, said belt-like means containing a plurality of tube-like hems for permitting said pole-like means to pass through and thereby support said tube-like hems whereby the height of the head bearing area of the belt-like means is rendered adjustable;

wherein the said belt-like means further comprises:

a plurality of elastic bands sewn to the said belt-like means around the head bearing area, and wherein a wrinkled surface is formed on the head bearing area of the said belt-like means.

2. An apparatus for use as a head rest comprising:

a belt-like means with a head bearing area which will form a generally spheric surface when bearing a head;

a support means formed with an empty interior space and having at least two pole-like means attached thereto, wherein over said pole-like means the said belt-like means is stretched, said belt-like means containing a plurality of tube-like hems for permitting said pole-like means to pass through and thereby support said tube-like hems whereby the height of the head bearing area of the belt-like means is rendered adjustable;

wherein the said support means further comprises:

four standards, each containing a plurality of horizontal holes and a notch, wherein said standards stand respectively at four corners of a rectangle, and wherein each notch is provided at the lower part of the standard with a horizontal hole in it:

two latitudinal base-plates, each with a hole at both ends, the four ends of the two base-plates being encased respectively into the said notches of said four standards so as to keep the four standards in a vertical condition:

two up-beams fixed respectively at the upper part of two pairs of standards, each pair containing a front standard and a back standard for supporting the said belt-like means;

two poles for being received respectively into any of said tube-like hems located on the two ends of the belt-like means and also into any pair of holes of said pair of standards containing a front standard and a back standard;

two longitudinal base-beams with a projection at both ends of each to serve as shoulders for holding elastic biasing means, and to pass through the holes at the ends of said latitudinal base-plates and then for encasing into the holes within said notches of said pairs of standards containing a front standard and a back standard;

four one-end-partial-blocked each covers with elastic biasing means fixed inside with each cover installed at the ends of said base-beams for biasing the four ends of said base-beams against the inside of said notches of said four standards; wherein the covers of the said longitudinal base-beams can being pushed against the biasing means, said two latitudinal base-plates can be pulled apart from the notches of said standards and therefore the standards will fall centerwards.

3. An apparatus for use as a head rest comprising:

a belt-like means with a head bearing area which will form a generally spheric surface when bearing a head;

a support means formed with an empty interior space and having at least two pole-like means attached thereto, wherein over said pole-like means the said belt-like means is stretched, said belt-like means containing a plurality of tube-like hems for permitting said pole-like means to pass through and thereby support said tube-like hems whereby the height of the head bearing area of the belt-like means is rendered adjustable;

wherein said support means further comprises:

four standards standing at four corners of a rectangle, each standard is provided with a vertical long slot and plurality of horizontal holes passing across said slot;

two latitudinal base-plates at the bottom of said standards for keeping said standards in a vertical condition;

two up-beams fixed respectively at the upper part of two pairs of standards, wherein each pair contains a front standard and a back standard, for holding the belt-like means;

two poles which can move up and down along said vertical slots of each pair of standards;

four pins selectively encased into the horizontal holes of the said standards; and two longitudinal base-plates separately fixed to said two latitudinal base-plates forming a rectangular profile.

4. An apparatus for use as a head rest according to claim 2 or 3 wherein the belt-like means further comprises:

a plurality of tube-like hems on at least one end of said belt-like means, and the distance between each hem is different from the distance which is between each horizontal hole of said standards.

5. An apparatus for use as a head rest according to claim 1, or 2, or 3 wherein said pole-like means are flexible.

6. An apparatus for use as a head rest according to claim 1, or 2, or 3 wherein an upward surface of the said pole-like means arcuate.

7. An apparatus for head rest according to claim 1, or 2, or 3 further comprising:

a cover to which a plurality of elastic bands are sewn.

* * * * *